US008753423B2

(12) United States Patent
Sugiura et al.

(10) Patent No.: US 8,753,423 B2
(45) Date of Patent: Jun. 17, 2014

(54) OPERATION METHOD FOR MECHANICALLY STIRRING CHROME-CONTAINING MOLTEN IRON

(75) Inventors: Masayuki Sugiura, Yamaguchi (JP); Masakazu Mori, Yamaguchi (JP); Takahiro Yoshino, Yamaguchi (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 13/516,945

(22) PCT Filed: Dec. 8, 2010

(86) PCT No.: PCT/JP2010/072051

§ 371 (c)(1),
(2), (4) Date: Jun. 18, 2012

(87) PCT Pub. No.: WO2011/083655

PCT Pub. Date: Jul. 14, 2011

(65) Prior Publication Data

US 2012/0260773 A1 Oct. 18, 2012

(30) Foreign Application Priority Data

Jan. 7, 2010 (JP) ..... 2010-002408

(51) Int. Cl.
*C22B 9/00* (2006.01)
*F27D 27/00* (2010.01)

(52) U.S. Cl.
USPC ..... 75/583; 266/44

(58) Field of Classification Search
USPC ..... 75/583; 266/44
See application file for complete search history.

(56) References Cited

U.S. PATENT DOCUMENTS 3,567,204 A * 3/1971 Tsutomu et al. ..... 266/235
3,664,826 A * 5/1972 Dieter et al. ..... 75/566

FOREIGN PATENT DOCUMENTS

| | | |
|---|---|---|
| JP | 2001-248976 | 9/2001 |
| JP | 2001-262212 | 9/2001 |
| JP | 2003-166010 | 6/2003 |
| JP | 2004-248975 | 9/2004 |
| JP | 2009-114506 | 5/2009 |

* cited by examiner

*Primary Examiner* — George Wyszomierski
*Assistant Examiner* — Tima M McGuthry Banks
(74) *Attorney, Agent, or Firm* — Clark & Brody

(57) ABSTRACT

A method for stirring chrome-containing molten iron comprises mechanically stirring chrome-containing molten iron contained in a refining vessel by the use of an impeller having a rotation axis in the vertical direction where the refining vessel is such that the horizontal cross section of the inner wall thereof is circular around the central axis of the vessel in the vertical direction and the impeller, as integrated with the axial rod covered with a refractory, rotates around the central axis of the axial rod, as the rotation axis thereof. The stirring mode is regularly or irregularly switched between a concentric stirring of the molten iron in a state where the rotation axis of the impeller is centered in the central axis of the vessel and an eccentric stirring of the molten iron in a state where the rotation axis of the impeller is decentered from the central axis of the vessel.

6 Claims, 5 Drawing Sheets

OPERATION METHOD FOR MECHANICALLY STIRRING CHROME-CONTAINING MOLTEN IRON

TECHNICAL FIELD

The present invention relates to an operation method of reducing erosion of an axial rod part rotating integrally with mixing blades (impeller) in a refining process of mechanically stirring chrome-containing molten iron (molten pig-iron or molten steel) with an impeller.

BACKGROUND ART

A refining process of mechanically stirring molten iron with an impeller has heretofore been applied mainly to desulfurization of blast furnace-derived molten pig-iron (for example, Patent References 1 to 4). In that regard, for enhancing the stirring efficiency, proposed is a stirring method where the rotation axis of the impeller is kept decentered from the central axis of the refining vessel (Patent Reference 3). According to the method, it is said that the revolutions per minute (r.P.m) could be reduced in a case of obtaining a predetermined desulfurization efficiency, and the life of the impeller could be prolonged.

On the other hand, in the production of molten stainless steel, a process of obtaining molten pig-iron or molten steel by the use of an electric furnace is the mainstream. In that case, $CaF_2$ (fluorite) may be incorporated in the slag in the electric furnace, or $CaF_2$ may be incorporated in the slag during the decarburizing stage, whereby the desulfurization can be attained relatively efficiently, and accordingly, a step of mechanically stirring molten pig-iron or molten steel is not specifically needed.

Recently, however, in use of steel slag as a ground or roadbed material, the content of the fluorine ingredient therein has become restricted, and therefore use of $CaF_2$-free slag has increased. In that case, the desulfurization capability of slag lowers, and therefore, in case where an ultra-low S molten stainless steel having an S content of, for example, at most 0.005% by mass is produced, it has become necessary to apply separate desulfurization treatment to the electric furnace molten pig-iron or steel for the purpose of reducing the desulfurization load in the already-existing steel-making process Regarding the desulfurization treatment, it has been confirmed that the same mechanical stirring method as that for blast furnace molten pig-iron is effective also for chrome-containing molten pig-iron or steel for stainless steel. For example, in case where CaO is used as the desulfurizing agent and when chrome-containing molten pig-iron or steel is mechanically stirred along with the desulfurizing agent (CaO-based slag), then the desulfurization reaction of the following formula (1) goes on. The generated oxygen reacts with the deoxidizing ingredient (for example, Si) in the molten iron, according to the following formula (2):

$$(CaO)+[S]=(CaS)+[O] \quad (1)$$

$$[Si]+2[O]=(SiO_2) \quad (2)$$

CITATION LIST

Patent References

Patent Reference 1: JP-A 2004-248975
Patent Reference 2: JP-A 2001-248976

Patent Reference 3: JP-A 2001-262212
Patent Reference 4: JP-A 2003-166010

SUMMARY OF THE INVENTION

Problems that the Invention is to Solve

As described above, in a case of mechanically stirring molten pig-iron or molten steel, when the stirring is attained in a state where the rotation axis of the impeller is decentered from the central axis of the refining vessel (eccentric stirring), then the stirring efficiency increases and therefore the revolutions per minute can be reduced for attaining the same desulfurization effect. However, in the present inventors' investigations, there occurred a problem in that, in the case of chrome-containing molten pig-iron or steel as differing from the case of blast furnace molten pig-iron, the refractory part of the axial rod that rotates integrally with the impeller is extremely readily eroded or melted during the operation of eccentric stirring (see FIG. 5 to be mentioned below). Consequently, even though the life of the impeller itself could be prolonged, the life of the axial rod part early comes to the end thereof, and therefore the change-out rate of the "rotor" composed of the impeller and the axial rod integral with each other is shortened.

In consideration of the situation as above, the present invention is to provide an operation method for noticeably prolonging the life of the "rotor" composed of an impeller and an axial rod integral with each other in mechanical stirring of chrome-containing molten pig-iron or steel.

Means for Solving the Problems

As a result of detailed investigations, the present inventors have found that, in mechanical stirring of chrome-containing molten pig-iron or steel, there exists a noticeable difference between the case of stirring in a state where the rotation axis of an impeller is centered in the central axis of a refining vessel (concentric stirring mode) and the case of stirring in a state where the former is decentered from the latter (eccentric stirring mode), in the material loss of the axial rod part that rotates integrally with the impeller. Specifically, in the case of the eccentric stirring mode, the material loss of the axial rod is extremely large, as described above. As opposed to this, in the case of the concentric stirring mode, scattered matters of slag and molten pig-iron or molten steel may readily adhere to the axial rod. Moreover, the materials adhered are hard and could not peel away with ease but have an effect of firmly protecting the refractory part of the axial rod. In other words, during stirring operation in the concentric stirring mode, a hard protective layer of the adhesion materials is naturally formed on the surface of the refractory axial rod, and therefore in this description, this phenomenon may be referred to as "self-repairing".

The refractory axial rod eroded in stirring in the eccentric stirring mode could be self-repaired by changing the subsequent stirring mode to the concentric stirring mode. Afterwards, by repeating the eccentric stirring mode and the concentric stirring mode, the amount of the slag and the scattering matters to be adhered to the axial rod can be controlled, whereby consequently the life of the refractory axial rod can be greatly prolonged. The present invention has been completed on the basis of these findings.

Specifically, according to the invention, there is provided an operation method for mechanically stirring chrome-containing molten iron, which comprises a refining process of mechanically stirring chrome-containing molten iron contained in a refining vessel by the use of an impeller having a rotation axis in the vertical direction where the refining vessel is such that the horizontal cross section of the inner wall thereof is circular around the central axis of the vessel in the vertical direction and the impeller, as integrated with the axial rod covered with a refractory, rotates around the central axis of the axial rod, as the rotation axis thereof, wherein:

the stirring mode is regularly or irregularly switched, as selected for each stirring charge, between "concentric stirring mode" of stirring the molten iron in a state where the rotation axis of the impeller is centered in the central axis of the vessel and "eccentric stirring mode" of stirring the molten iron in a state where the rotation axis of the impeller is decentered from the central axis of the vessel.

As one embodiment of regularly switching the mode, preferably employed here is a method where the concentric stirring mode and the eccentric stirring mode are alternately switched at every one stirring charge.

As the chrome-containing molten iron, more effectively used here is molten pig-iron or molten steel having a Cr content (at the start of stirring of each stirring charge) of from 8 to 35% by mass. One typical candidate is molten pig-iron or molten steel which is to be formed into stainless steel by another subsequent refining process and casting. "Stainless steel" as referred to herein is defined as Number 3801 of JIS G0203:2009, and the steel includes concretely austenitic steel types defined in Table 2 of JIS G4305:2005, austenitic ferritic steel types defined in Table 3 thereof, ferritic steel types defined in Table 4 thereof, martensitic steel types defined in Table 5 thereof, precipitation hardened steel types defined in Table 6 thereof; and in addition to these, other various types of developed steel not corresponding to JIS could also be the objects of the invention. Especially preferred objects are ultra-low S steel types (for example, having an S content of at most 0.005% by mass) with the base of those ingredient systems.

Especially preferably, in the eccentric stirring mode, the rotation axis of the impeller is decentered from the central axis of the vessel within a range of from 0.20 D to 0.45 D where D (mm) means the initial axial rod diameter that indicates the refractory diameter in the initial state of the axial rod part sinking below the fluid level of the molten matter before the start of the rotation. The initial axial rod diameter D may be within a range of from 10 to 30% of $D_0$ where $D_0$ (mm) means the inner diameter of the refining vessel at the position of the height of the mean fluid level of the molten matter being stirred.

The "molten matter" as referred to herein means a substance in a molten state in the refining vessel, concretely including chrome-containing molten iron (molten pig-iron or molten steel), and flux for refining and slag to be stirred along with it. The "position of the height of the mean fluid level of the molten matter being stirred" corresponds to the position of the height of the mean fluid level of the molten matter on the assumption that the stirring is stopped and the fluid level is kept static. In case where the height of the mean fluid level fluctuates, for example, in such a case that flux or the like is put into the system in the course of stirring, the highest position is employed.

Advantage of the Invention

According to the invention, in mechanically stirring chrome-containing molten iron (molten pig-iron or molten steel), the period of time to exchange the rotor that comprises an impeller integrated with the axial rod thereof can be greatly prolonged. Accordingly, the invention contributes toward performance increase and cost reduction in the step of promoting reaction by mechanical stirring, such as desulfurization treatment or reduction and recovery of chrome from the slag, in a process of refining chrome-containing steel such as typically stainless steel.

MODE FOR CARRYING OUT THE INVENTION

Figure 1:
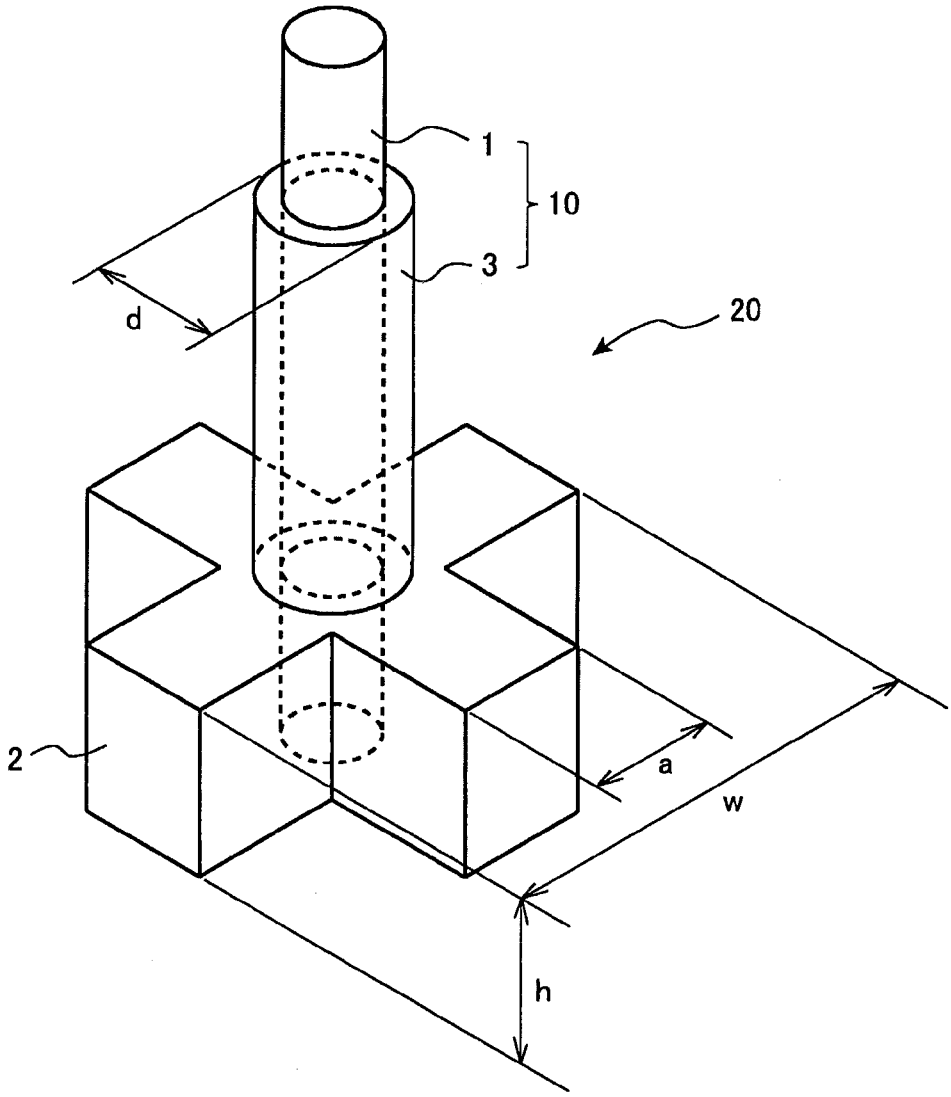
FIG. 1 This is a view schematically illustrating the shape of a rotor in the initial state thereof.

FIG. 1 schematically illustrates the configuration of a rotor to be applied to the mechanical stirring in the invention, in the initial state thereof (before used). An impeller 2 is fitted to the lowest part of axial core 1 formed of a steel material or the like. Inside the impeller 2, in general, there exists a core material (not shown) formed of a steel material, as connected with the axial core 1, and the impeller 2 is constructed by covering the core material serving as a base with a refractory. Around the axial core 1, formed is a refractory layer 3 so as to protect the axial core 1 formed of a steel material or the like from being directly exposed to a molten material. An axial rod 10 is composed of the axial core 1 and refractory layer 3 around it. The impeller 2 and the axial rod 10 rotate integrally with each other. The integrated structure is referred to as a rotor 20.

Figure 2:
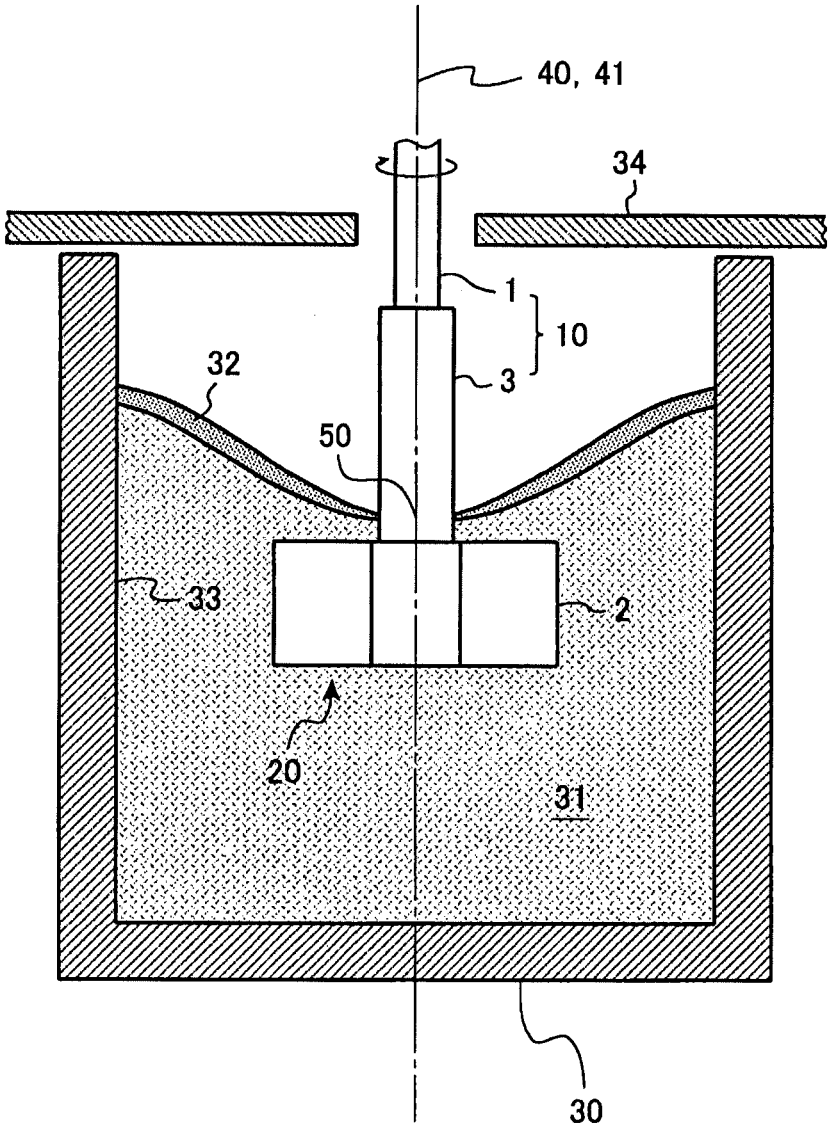
FIG. 2 This is a partial cross-sectional view schematically showing the configuration of each part in a refining vessel in which chrome-containing molten iron is mechanically stirred in a concentric stirring mode.

FIG. 2 schematically shows the configuration of each part in a refining vessel in which chrome-containing molten iron is mechanically stirred in a concentric stirring mode. This shows a cross section of the vessel including central axis 40 thereof and rotation axis 41, in which only rotor 20 is shown as the side view thereof (the same shall apply to FIG. 4 to be mentioned below).

Refining vessel 30 to be used here is such that the horizontal cross section of inner wall 33 thereof is circular around central axis 40 of the vessel in the vertical direction. The "horizontal cross section" is a cross section vertical to the central axis 40 of the vessel standing in the vertical direction. "Circular" accepts ordinary irregularities (deviation from perfect circle) to occur in constructing inner wall 33 from a refractory. The inner diameter of the refining vessel 30 may be uniform in the height direction or may not be uniform. For example, a refining vessel of which the inner diameter increases upward from the bottom may be used here.

The rotor 20 is so designed that the upper part of the axial rod 10 thereof is fixed to the rotary member that is rotated by the driving force of a motor, and by changing the position of the rotary member, the height position and the horizontal position of the rotor 20 can be set at predetermined positions. In the concentric stirring mode, rotation axis 41 and central axis 40 of the vessel correspond to each other, and therefore, when the stirring with the rotor 20 is started, then the eddy core 50 of the fluid formed of chrome-containing molten iron 31 and flux and/or slag 32 is formed at the center position of the refining vessel 30. With that, the molten material level is low at the position of the eddy core 50 and is high at around the peripheral part. In FIG. 2, the molten material level fluctuation is overdrawn (the same shall apply to FIG. 4 to be mentioned below). With the rotation, the interface between chrome-containing molten iron 31 and flux and/or slag 32 may be complicated, but in FIG. 2, the interface is drawn in a simplified manner (the same shall apply to FIG. 4 to be mentioned below). The height position of the rotor 20 is so set that the top of the impeller 2 could be lower than the molten material level of the eddy core 50. The upper open mouth of the refining vessel 30 is closed mostly with hood 34 except the area around the axial rod 10.

When the molten iron is stirred in a concentric stirring mode, the adhesion material layer caused by slag, molten pig-iron or molten steel is formed onto axial rod 10 in the part near the molten material surface and in the part upper than the molten material surface, during rotation of the axial rod 10. The adhering amount of the adhesion material tends to be considerably large as compared with that in stirring of blast furnace pig-iron. Moreover, the adhesion material layer is hard. The present inventors analyzed the adhesion material formed in stirring of chrome-containing molten pig-iron or steel, and have found that the material contains a chromium oxide ingredient. It is presumed that the specific composition of the adhesion material would contribute toward self-repairing of the eroded part of the refractory axial rod, as described below.

Figure 3:
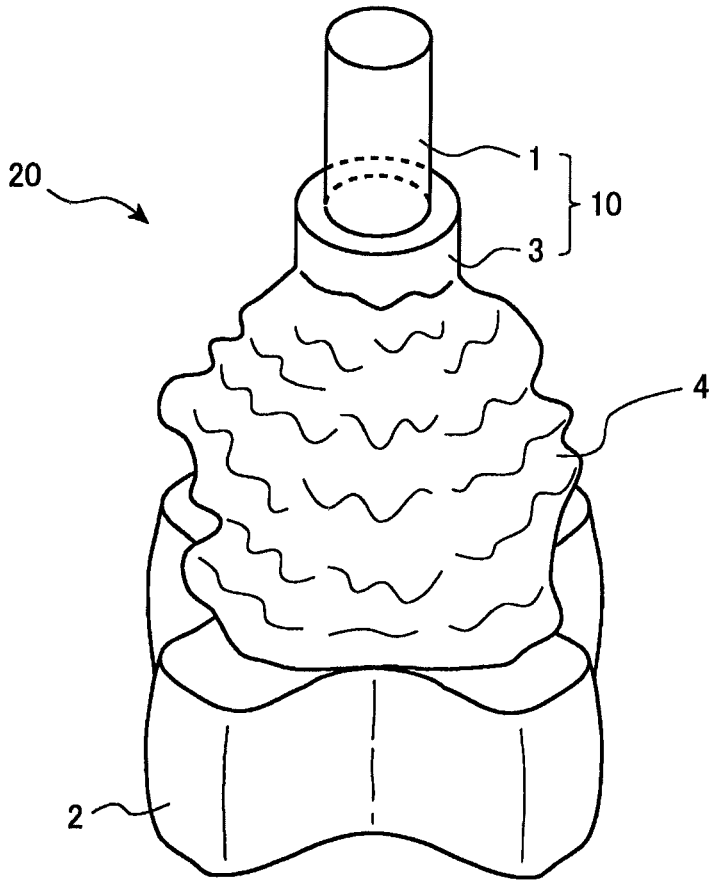
FIG. 3 This is a view schematically illustrating the outward appearance of a rotor that is to be exchanged in continuous mechanical stirring of chrome-containing molten iron in a concentric stirring mode.

FIG. 3 schematically illustrates the outward appearance of a rotor after about 50 charges in continuous mechanical stirring of chrome-containing molten pig-iron or steel in a concentric stirring mode. The surface of the refractory layer 3 to constitute the axial rod 10 is covered thickly with hard adhesion material 4. In that condition, it is extremely difficult to remove the adhesion material 4 with hammer or any other tool. In addition, when the apparent diameter of the axial rod 10 increases more owing to the adhesion material 4, then the amount of the slag or the molten metal to scatter during rotation may increase more and the adhering speed of the adhesion material 4 thereby increases more and more. Consequently, in case where the mechanical stirring of chrome-containing molten iron is attained only in a concentric stirring mode, the rotor must be frequently exchanged.

Figure 4:
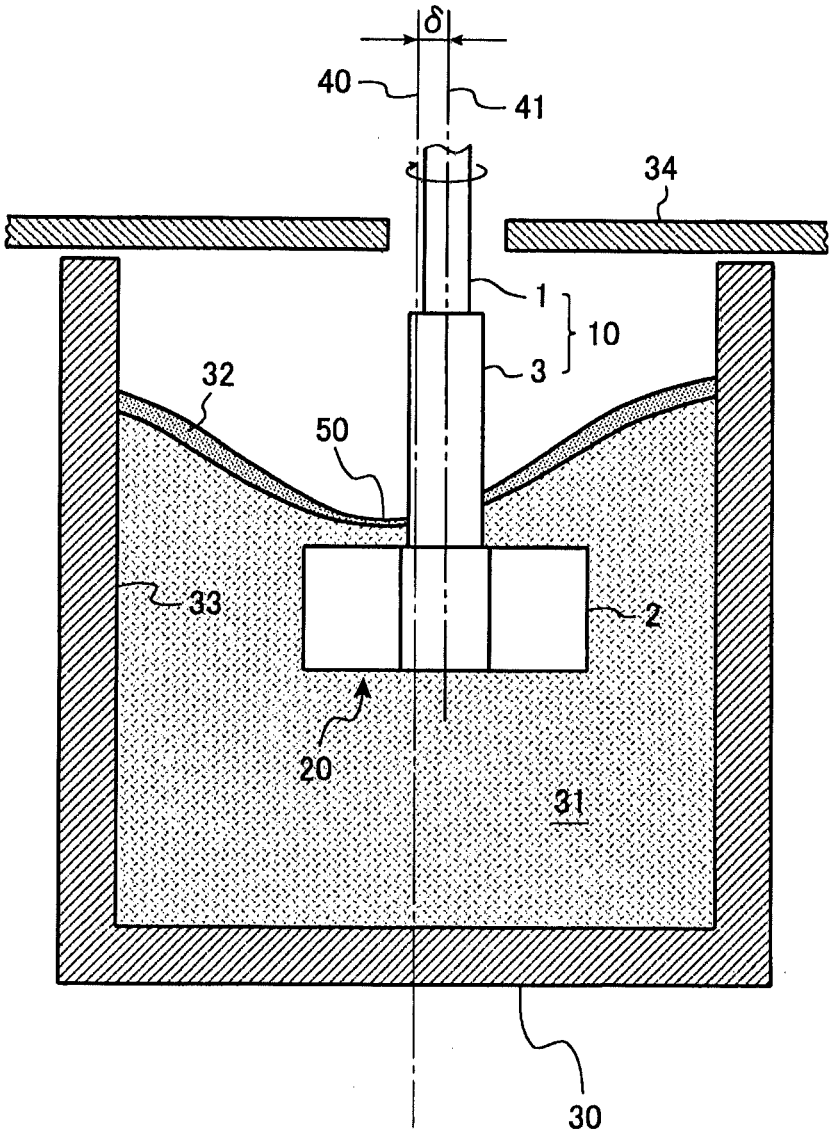
FIG. 4 This is a partial cross-sectional view schematically showing the configuration of each part in a refining vessel in which chrome-containing molten iron is mechanically stirred in an eccentric stirring mode.

FIG. 4 schematically shows the configuration of each part in a refining vessel in which chrome-containing molten pig-iron or steel is mechanically stirred in an eccentric stirring mode. The rotor 20 rotates in the condition where the rotation axis 41 thereof is decentered from the central axis 40 of the vessel by the eccentric degree δ. In this case, the eddy core 50 is shifted to the opposite side to the rotation axis 41 relative to the central axis 40 of the vessel. The degree of shifting of the eddy core 50 from the center position of the vessel is nearly the same as the eccentric degree δ Also in the eccentric stirring mode, the height position of the rotor 20 is so set that the top of the impeller 2 could be lower than the molten metal level of the eddy core 50.

Also in the eccentric stirring mode, slag and molten metal may scatter from the molten metal surface. However, though the adhesion material layer caused by the scattering is formed extremely easily in the concentric stirring mode, the adhesion could extremely hardly occur to such part of the axial rod 10 that is washed by the fluctuation in the molten material surface level in the eccentric stirring mode. Moreover, it has been clarified that the refractory layer 3 in that part is extremely easily eroded.

Figure 5:
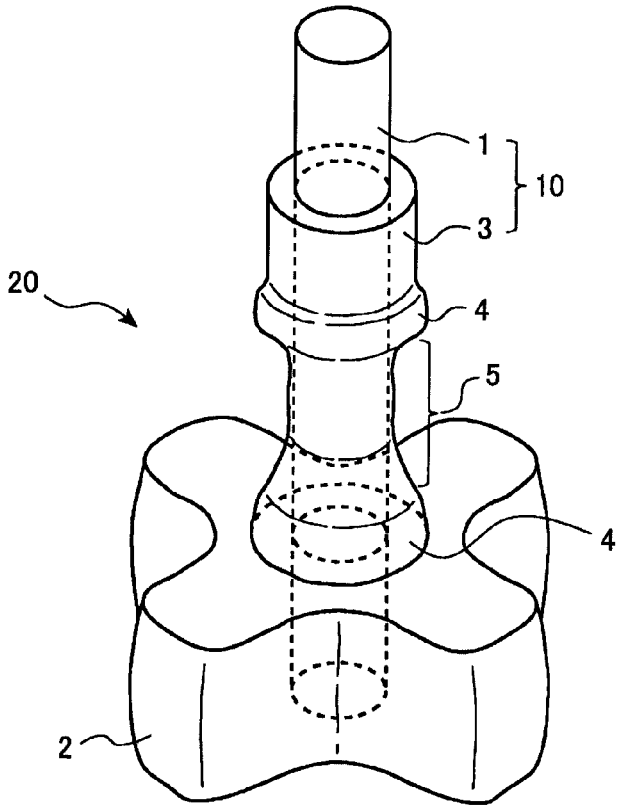
FIG. 5 This is a view schematically illustrating the outward appearance of a rotor that is to be exchanged in continuous mechanical stirring of chrome-containing molten iron in an eccentric stirring mode.

FIG. 5 schematically illustrates the outward appearance of a rotor after about 150 charges of continuous mechanical stirring of chrome-containing molten pig-iron or steel in an eccentric stirring mode. The adhesion material 4 could be seen on partial surface of the refractory layer 3 that constitutes the axial rod 10, but the refractory layer 3 of other part that is washed by the molten material surface was greatly eroded or melted thereby giving an eroded refractory part 5 that was thinned to have a smaller diameter than the diameter of the initial refractory layer 3. When the diameter of the eroded refractory part 5 approaches to the diameter of the axial core 1, then further use of the rotor 20 must be evaded and the rotor must be exchanged. The number of charges to reach that state may vary depending on the condition, but in usual operation, the life of the rotor falls between about 80 and 180 charges in many cases. Blast furnace molten pig-iron does not almost bring about such a problem of remarkable erosion or melt even when continuously stirred in an eccentric stirring mode. Rather in such a case, the wear and tear of the impeller 2 is often a determinative factor of the life of the rotor 20. The reason why chrome-containing molten iron causes the above-mentioned severe erosion is not always clarified as yet at least at present; however, it may be considered that a large amount of Cr that is an easily-oxidizable element is contained in molten pig-iron and molten steel and would be a factor of facilitating the erosion of refractory. In addition, another reason would be that the temperature of the molten pig-iron or molten steel to be stirred is relatively high.

[Operation Method of the Invention]

In the invention, while one rotor 20 is continuously used, not exchanged during the term, the operation is switched regularly or irregularly between a concentric stirring mode and an eccentric stirring mode, as selected for every stirring charge. With the charge stirred in an eccentric stirring mode, the erosion of the axial rod 10 goes on as mentioned above. With the subsequent charge stirred in a concentric stirring mode, the eroded part of the axial rod 10 is coated with a hard adhesion material, thereby exhibiting the above-mentioned "self-repairing" effect. In that manner, frequently repeating the "erosion" in the eccentric stirring mode and the "self-repairing" in the concentric stirring mode makes it possible to control the adhering amount of the adhesion material to the axial rod 10 whereby the erosion of the refractory layer 3 that constitutes the axial rod 10 can be greatly reduced. The layer of the adhesion material formed in the concentric stirring mode is mostly melted away in the subsequent eccentric-mode stirring charges, and accordingly, the state where the axial rod 10 is covered with the excessive adhesion material 4 as shown in FIG. 3 could be thereby evaded.

As one embodiment where the concentric stirring mode and the eccentric stirring mode are regularly selected for each stirring charge, for example, there is mentioned an embodiment where the two modes are alternately switched at every one charge. In addition, other preferred embodiments may be determined for the prolongation of the life of the rotor 20 based on previous experimental data and past operation data in accordance with (i) the condition of the apparatus, (ii) the composition of chrome-containing molten pig-iron or steel to be stirred, the composition of slag, and the temperature condition thereof, (iii) the stirring condition, etc. For example, there may be mentioned an embodiment where a cycle of "eccentric stirring mode×two times→concentric stirring mode×one time" is repeated. Also employable here is a "variable pattern" where the mode switching pattern is changed depending on the rotor use frequency.

Regarding the method of irregularly selecting the two modes for every stirring charge, there is mentioned a method that comprises measuring the eroded amount of the refractory layer 3 or the adhering amount of the adhesion material 4 after every one charge or at regular charge intervals and then determining the stirring mode for the subsequent charges before the next inspection.

It is effective that the eccentric degree δ (the distance between the central axis 40 of the vessel and the rotation axis 41) in the eccentric stirring mode is set in accordance with the diameter of the axial rod 10. The diameter of the axial rod 10 in this case may be based on the diameter thereof of the rotor 20 before use in the first charge (the diameter in the unused state). In this description, that diameter is referred to as "initial axial rod diameter" and is represented by a symbol D. The initial axial rod diameter D (mm) is the refractory diameter in the initial state of the axial rod part sinking below the fluid level of a molten material before the start of the rotation (or that is, in case where the molten surface level is equivalent in the vessel). In case where the diameter of the axial rod part varies in different sites (for example, in case where the outer diameter of axial rod 10 varies in the height direction), the diameter of the thinnest part of the axial rod part may be taken as the initial axial rod diameter D. Using the rotor 20 is especially effective in which the initial axial rod diameter D is from 15 to 30% of the inner diameter $D_0$ of the refining vessel (as mentioned above).

As a result of various investigations, the eccentric degree δ is effectively at least 0.20 D in an eccentric stirring mode. When the eccentric degree δ is smaller than the above, then the predominance with occurring "erosion of the refractory layer 3" and "adhering of adhesion material 4" may be unstable, and it may be often difficult to stably realize the stirring condition in which the erosion is predominant. The upper limit of the eccentric degree δ may be physically restricted by the size of impeller 2 and refining vessel 30 and is therefore unnecessary to be specifically defined. However, larger δ is not always effective but too large δ may be a cause of cost increase. In addition, when δ is too large, then the impeller during rotation may vibrate too much and may cause device failure. In general, the eccentric degree δ falling within a range of from 0.20 D to 0.45 D could produce a good result. The degree may be controlled to fall within a range of from 0.20 D to 0.40 D, or within a range of from 0.20 D to 0.35 D.

On the other hand, in the concentric stirring mode, the rotation axis 41 may be misaligned somewhat from the predetermined position owing to inevitable equipment-related reasons. As a result of various investigations, the degree of misalignment is acceptable up to 0.10 D. When the degree of misalignment is more than 0.10 D, then the predominance with occuring "erosion of the refractory layer 3" and "adhering of adhesion material 4" may be unstable, and it may be often difficult to stably realize the stirring condition in which the adhering is predominant. More preferably, the degree of misalignment is suppressed to be at most 0.05 D.

The size of the refining vessel is not specifically defined. For example, the invention is applicable to the vessel of which the above-mentioned inner diameter $D_0$ is from 1000 to 4500 mm or so.

Figure 6:
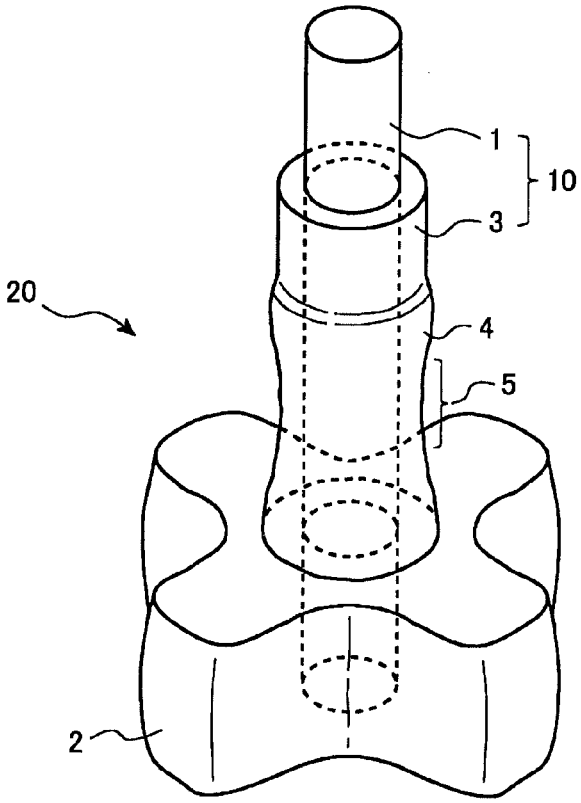
FIG. 6 This schematically illustrates the outward appearance of a rotor that is considered to be still usable in a case where mechanical stirring of chrome-containing molten iron is continued while the stirring mode is switched alternately between a concentric stirring mode and an eccentric stirring at every one stirring charge.

FIG. 6 schematically illustrates the outward appearance of a rotor after about 150 charges of continuous mechanical stirring of chrome-containing molten pig-iron or steel in a concentric stirring mode and an eccentric stirring mode alternately switched at every one charge. The condition of the rotor in this case is the same as that in the above-mentioned FIG. 4 except that the two modes are switched; and in this case, owing to the above-mentioned "self-repairing effect", the erosion loss of the refractory at the eroded part 5 could reduce and the rotor can be further used still continuously.

EXAMPLES

Electric furnace molten pig-iron in a production of molten stainless steel was desulfurized according to a method of mechanically stirring it with a rotor. In the case, one rotor was continuously used until its life (when the rotor came to be exchanged), and on the basis of the pass counts (number of processed stirring charges) therewith, the relative merits of the mechanical stirring operation with the rotor (Examples shown in Table 1) were evaluated.

As the refining vessel, used here was a ladle having a cylindrical inner wall and having an inner diameter $D_0$ of 2760 mm.

As the rotor, used here is one having the initial shape shown in FIG. 1. The diameter of the refractory layer 3 is uniform in the height direction. Accordingly, the dimension expressed as d in FIG. 1 corresponds to the initial axial rod diameter D. The value D in each Example is shown in Table 1. The dimension of the impeller 2 is w=1200 mm and h=700 mm in FIG. 1; and the blade thickness a is nearly the same as the initial axial rod diameter D. The dipping depth of the rotor is, based on the molten material level in a state where the rotor is kept static, was so controlled that the depth from the molten material surface to the top of the impeller could be 500 mm. The stirring time in one charge was 600 seconds, and the revolution number of the rotor was within a range of from 80 to 120 r.p.m.

The amount of chrome-containing molten pig-iron to be stirred in one charge is about 80 tons. Regarding the type of the pig-iron treated here, Fe—Cr—Ni-based molten pig-iron for austenitic stainless steel accounted for from about 40 to 60% of all the stirring charges until the life of the rotor, and Fe—Cr-based molted pig-iron for ferritic stainless steel accounted for the remaining stirring charges. The temperature of the chrome-containing molten pig-iron at the start of stirring was within a range of from 1390 to 1450° C.

After every charge, the "diameter of the axial rod part" and the "erosion loss of the impeller" were checked, and when any of either measured up to the standard, the life of the rotor was considered to have come an end. The outer diameter standard of the axial rod part was at the time when the diameter of the most-eroded part became more than [initial axial rod diameter D—100 mm], or when the apparent outer diameter of the axial rod became thick owing to adhering the adhesion material thereto and further use of the rotor would cause some trouble owing to the increase in the scattering amount of slag or molten pig-iron or owing to unstable rotation of the rotor. The erosion loss standard of the impeller was at the time when the intended desulfurization of chromium reduction recovery could not be attained within a predetermined period of time (600 seconds) if the revolution number is not increased up to 130 r.p.m. or more.

The operation condition and the result in each Example are shown in Table 1. In this, in the Example where the expression "regular" is given to the column of mode switching pattern, the concentric stirring mode and the eccentric stirring mode were alternately switched at every stirring charge. In the Example where the expression "irregular" is give thereto, the erosion loss of the refractory layer 3 or the adhered amount of adhesion material 4 was checked after every charge, and in case where self-repairing by the adhesion was considered to be necessary in the next charge, the concentric stirring mode was selected, and in the other cases, the eccentric stirring mode was selected, and in that manner, the two modes were suitably switched. However, the same stirring mode must not be continued 3 times or more. In the Example where "CaO—$Al_2O_3$" is given to the column of slag, all charges are for desulfurization.

TABLE 1

| Example No. | Rotor No. | Initial Axial Rod Diameter D (mm) | $D/D_0 \times 100$ (%) | Stirring Mode | Mode Switching Pattern | Eccentric Degree δ in Eccentric Stirring Mode | Slag *1 | Rotor Life (number of charges) | Cause of Rotor Life |
|---|---|---|---|---|---|---|---|---|---|
| Comparative Example 1 | 1 | 550 | 19.9 | eccentric mode alone | — | 0.30D | CaO—$Al_2O_3$ | 143 | axial rod erosion |
| Comparative Example 2 | 2 | 580 | 21.0 | eccentric mode alone | — | 0.26D | CaO—$Al_2O_3$ | 174 | axial rod erosion |
| Comparative Example 3 | 3 | 600 | 21.7 | eccentric mode alone | — | 0.25D | CaO—$Al_2O_3$ | 99 | axial rod erosion |
| Comparative Example 4 | 4 | 580 | 21.0 | concentric mode alone | — | — | CaO—$Al_2O_3$ | 50 | axial rod thickening |
| Example 1 | 5 | 500 | 18.1 | concentric/eccentric combined mode | regular | 0.30D | CaO—$Al_2O_3$ | 281 | axial rod erosion |
| Example 2 | 6 | 550 | 19.9 | concentric/eccentric combined mode | regular | 0.30D | CaO—$Al_2O_3$ | 318 | axial rod erosion |
| Example 3 | 7 | 580 | 21.0 | concentric/eccentric combined mode | regular | 0.26D | CaO—$Al_2O_3$ | 204 | axial rod erosion |
| Example 4 | 8 | 580 | 21.0 | concentric/eccentric combined mode | regular | 0.20D to 0.45D | CaO—$Al_2O_3$ | 298 | axial rod erosion |
| Example 5 | 9 | 600 | 21.7 | concentric/eccentric combined mode | regular | 0.25D | CaO—$Al_2O_3$ | 324 | axial rod erosion |
| Example 6 | 10 | 650 | 23.6 | concentric/eccentric combined mode | regular | 0.20D | CaO—$Al_2O_3$ | 266 | axial rod erosion |
| Example 7 | 11 | 580 | 21.0 | concentric/eccentric combined mode | irregular | 0.26D | CaO—$Al_2O_3$ | 312 | axial rod erosion |

*1 Type of slag in stirring treatment of every charge

As seen from Table 1, the life of the rotor was extremely prolonged in Examples where the two modes were suitably switched, as compared with that in Comparative Examples where all the charges were processed in the eccentric stirring mode alone or in the concentric stirring mode alone.

DESCRIPTION OF REFERENCE NUMERALS

| | |
|---|---|
| 1 | Axial Core |
| 2 | Impeller |
| 3 | Refractory Layer |
| 4 | Adhesion Material |
| 5 | Refractory Eroded Part |
| 10 | Axial Rod |
| 20 | Rotor |
| 30 | Refining vessel |
| 31 | Chrome-Containing Molten Iron |
| 32 | Flux and/or Slag |
| 33 | Inner Wall |
| 34 | Hood |
| 40 | Central Axis of Vessel |
| 41 | Rotation Axis |
| 50 | Eddy Core |

The invention claimed is:

1. An operation method for mechanically stirring chrome-containing molten iron, which comprises a refining process of mechanically stirring chrome-containing molten iron contained in a refining vessel by a use of an impeller having a rotation axis in a vertical direction where the refining vessel is such that a horizontal cross section of an inner wall thereof is circular around a central axis of the vessel in the vertical direction and the impeller, as integrated with an axial rod covered with a refractory, rotates around a central axis of the axial rod, as a rotation axis thereof, wherein:

a stirring mode is regularly or irregularly switched, as selected for a stirring charge, between concentric stirring mode of stirring the molten iron in a state where the rotation axis of the impeller is centered in the central axis of the vessel and eccentric stirring mode of stirring the molten iron in a state where the rotation axis of the impeller is decentered from the central axis of the vessel.

2. The operation method for mechanically stirring chrome-containing molten iron as claimed in claim 1, wherein the concentric stirring mode and the eccentric stirring mode are alternately switched at every one stirring charge.

3. The operation method for mechanically stirring chrome-containing molten iron as claimed in claim 1, wherein the chrome-containing molten iron is molten pig-iron or molten steel to be formed into stainless steel in a subsequent step of another refining and casting.

4. The operation method for mechanically stirring chrome-containing molten iron as claimed in claim 1, wherein the chrome-containing molten iron is molten pig-iron having a Cr content of from 8 to 35% by mass.

5. The operation method for mechanically stirring chrome-containing molten iron as claimed in claim 1, wherein, in the eccentric stirring mode, the rotation axis of the impeller is decentered from the central axis of the vessel within a range of from 0.20 D to 0.45 D where D is in mm and means an initial axial rod diameter that indicates a refractory diameter in an initial state of an axial rod part sinking below a fluid level of the molten material before a start of the rotation.

6. The operation method for mechanically stirring chrome-containing molten iron as claimed in claim 1, wherein an initial axial rod diameter D is 10 to 30% of a diameter $D_0$ where $D_0$ is in mm and means an inner diameter of the refining vessel at a position of a height of a mean fluid level of the molten material being stirred.

* * * * *